US006425634B1

(12) United States Patent
Romero

(10) Patent No.: US 6,425,634 B1
(45) Date of Patent: Jul. 30, 2002

(54) ASSIST APPARATUS FOR PATIENTS IN A WHEELCHAIR

(76) Inventor: Cliffard Romero, 1409 Jefferson St., Lafayette, LA (US) 70501

( * ) Notice: Subject to any disclaimer, the term of this patent is extended or adjusted under 35 U.S.C. 154(b) by 0 days.

(21) Appl. No.: 09/766,371

(22) Filed: Jan. 19, 2001

(51) Int. Cl.[7] ..... A47C 1/00

(52) U.S. Cl. ..... 297/331; 297/316; 297/DIG. 4; 297/DIG. 10

(58) Field of Search ..... 297/331, 316, 297/DIG. 4, DIG. 10

(56) References Cited

U.S. PATENT DOCUMENTS

| | | | | |
|---|---|---|---|---|
| 2,729,272 A | | 1/1956 | Lidge et al. | |
| 3,954,195 A | | 5/1976 | Deuchar | |
| 3,964,786 A | * | 6/1976 | Mashuda | 297/DIG. 10 X |
| 4,067,249 A | * | 1/1978 | Deucher | 297/DIG. 4 X |
| 4,076,304 A | * | 2/1978 | Deucher | 297/DIG. 10 X |
| 4,415,202 A | * | 11/1983 | Pew | 297/DIG. 10 X |
| 4,519,649 A | * | 5/1985 | Tanaka et al. | 297/DIG. 10 X |
| 4,598,944 A | * | 7/1986 | Meyer et al. | 297/DIG. 4 X |
| 4,623,194 A | * | 11/1986 | Pilot | 297/DIG. 10 X |
| 4,778,217 A | | 10/1988 | Lane | 297/DIG. 10 X |
| 4,809,804 A | * | 3/1989 | Houston et al. | 297/DIG. 4 X |
| 4,907,303 A | * | 3/1990 | Baird | 297/DIG. 10 X |
| 4,929,022 A | | 5/1990 | Geraci | 297/DIG. 4 X |
| 4,979,726 A | | 12/1990 | Geraci | 297/DIG. 10 X |
| 5,039,165 A | | 8/1991 | Rothman | 297/DIG. 4 X |
| 5,096,008 A | * | 3/1992 | Mankowski | 297/DIG. 4 X |
| 5,108,202 A | * | 4/1992 | Smith | 297/DIG. 10 X |
| 5,203,610 A | * | 4/1993 | Miller | 297/DIG. 4 X |
| 5,490,687 A | | 2/1996 | Scholl | 297/DIG. 10 X |
| 5,556,121 A | * | 9/1996 | Pilot | 297/DIG. 10 X |
| 5,794,284 A | * | 8/1998 | Southwell, Jr. et al. | 297/DIG. 10 X |
| 6,244,662 B1 | * | 6/2001 | Porcheron | 297/DIG. 4 X |
| 6,250,717 B1 | * | 6/2001 | Porcheron | 297/DIG. 4 X |

FOREIGN PATENT DOCUMENTS

| | | | |
|---|---|---|---|
| WO | WO88/10082 | 6/1988 | A47C/1/023 |

* cited by examiner

*Primary Examiner*—Peter M. Cuomo
*Assistant Examiner*—Rodney B. White
(74) *Attorney, Agent, or Firm*—Garvey, Smith, Nehrbass & Doody, LLC; Gregory C. Smith

(57) ABSTRACT

An apparatus, adaptable to a wheelchair, for assisting a person seated in the wheelchair to move to a standing position, the apparatus including a member slidable upward and downward along the chair; a seat, having a seat portion hinged to a back portion; at least one flexible strap member, engaged at a first end to the slidable member, and traveling along an under surface of the seat, and engaged at a second end to a stationary portion of the wheelchair, so that when the slidable member is moved to a down position, the flexible strap is pulled taut beneath the seat, lifting the seat from a sitting position to a substantially raised flat position, so that a person sitting in the seat is likewise lifted from a seated position to a partially standing position. The slidable member may be positioned along the front or rear of the chair, depending whether the person would be assisted by a third person in front of or behind the chair.

13 Claims, 6 Drawing Sheets

ASSIST APPARATUS FOR PATIENTS IN A WHEELCHAIR

CROSS-REFERENCE TO RELATED APPLICATIONS

Not applicable

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The apparatus of the present invention relates to wheelchairs. More particularly, the present invention relates to an apparatus that may be adaptable to an existing wheelchair to assist in lifting a patient from the chair or returning the patient to a chair by a third party, such as a nurse or health care giver.

2. General Background of the Invention

Because of ailments or old age, many people are unfortunately confined to wheelchairs for extended periods of time, or in the case of the elderly, for the remainder of their lives. A wheelchair is a very vital vehicle in allowing people who are not ambulatory to be able to get from place to place. However, particularly in the group of the very aged, or the very weak, the task of moving from the seated position in a wheelchair to a standing position, can be a very difficult task for the person confined to the chair, or even when the person is being assisted by a third party. For example, for people who are able to stand briefly, but are unable to walk because they are too weak, oftentimes they will have insufficient strength to lift themselves from the chair to the standing position, even to move into bed. These types of individuals are in need of assistance in helping them to stand, or, when they return to the chair, in being seated slowly, since they are too weak to lower themselves slowly into the chair.

Therefore, there is a need for an apparatus to assist such wheelchair bound individuals in moving from and returning to the chair, without placing undue strain on the individual, or on a third party, such as a nurse or care giver, who assists the person in this task. The prior art statement accompanying this application cites prior art patents which may be pertinent in the art, but fall short of solving the problems presented.

BRIEF SUMMARY OF THE INVENTION

The apparatus of the present invention solves the problems in a simple and straightforward manner. What is provided is an apparatus, adaptable to a wheelchair, for assisting a person seated in the wheelchair to move to a standing position, the apparatus including a member slidable upward and downward along the chair; a seat, having a seat portion hinged to a back portion; at least one flexible strap member, engaged at a first end to the slidable member, and traveling along an under surface of the seat, and engaged at a second end to a stationary portion of the wheelchair, so that when the slidable member is moved to a down position, the flexible strap is pulled taut beneath the seat, lifting the seat from a sitting position to a substantially raised flat position, so that a person sitting in the seat is likewise lifted from a seated position to a partially standing position. The slidable member may be positioned along the front or rear of the chair, depending whether the person would be assisted by a third person in front of or behind the chair.

Therefore, it is a principal object of the present invention to provide a wheelchair assist apparatus which allows a third person to maneuver the seat of the chair from a sitting position to a second position, moving the person in the chair to a substantially standing position;

It is a further object of the present invention to provide a wheelchair assist apparatus which, upon a third person engaging a foot member, the seat of the chair is pushed upward to lift the person seated in the chair to a standing position;

It is a further object of the present invention to provide an apparatus to assist a person to be lifted from the chair with ease, or to return to the chair without having to "fall" within the chair;

It is still a further object of the invention to provide an apparatus which is adaptable to an existing wheel chair which would allow the person in the chair to be lifted with the assistance of a third person with ease from the chair, either from the rear of the front of the chair.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
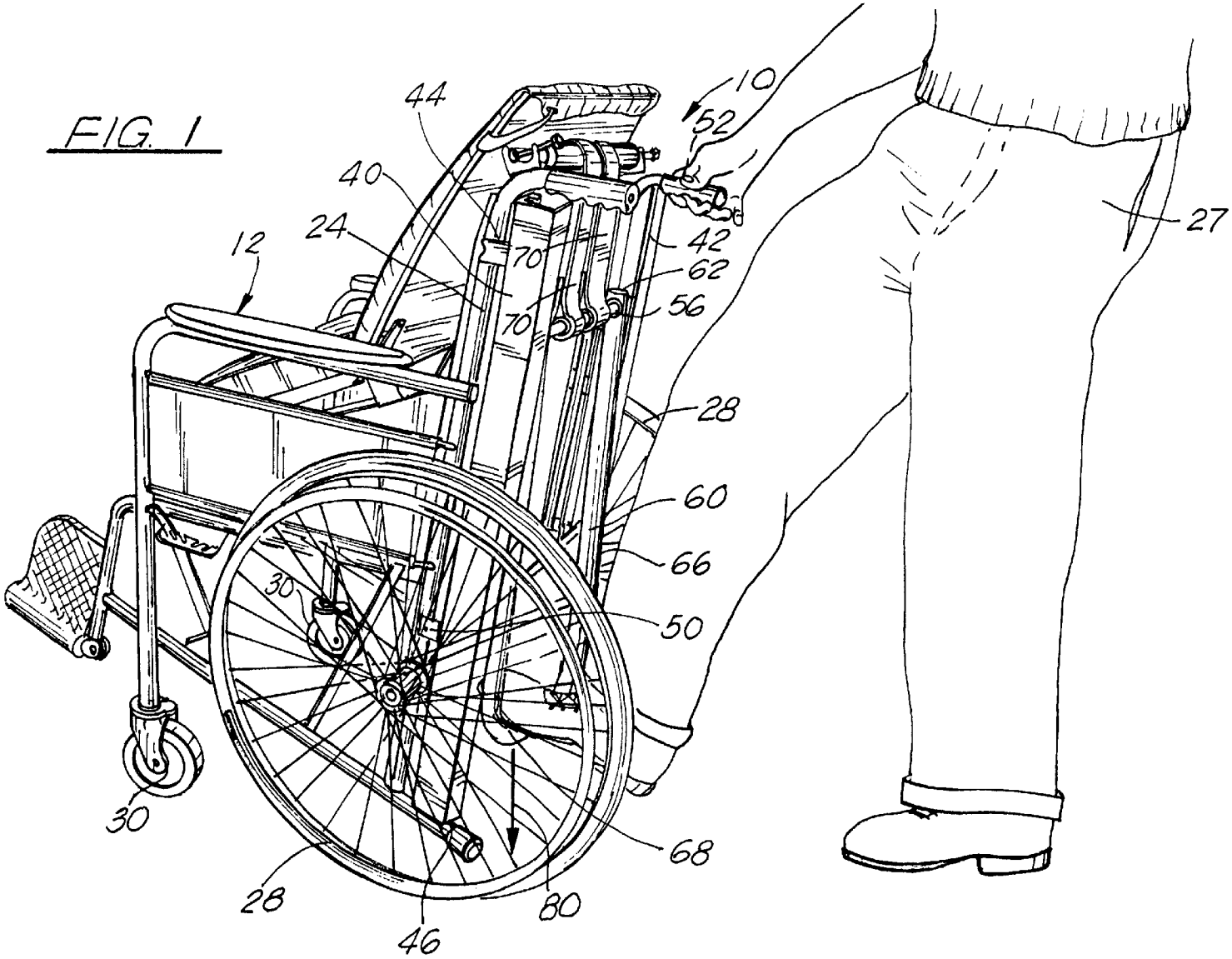
FIG. 1 is an overall view of the apparatus of the present invention mounted on a typical wheelchair.
Figure 2:
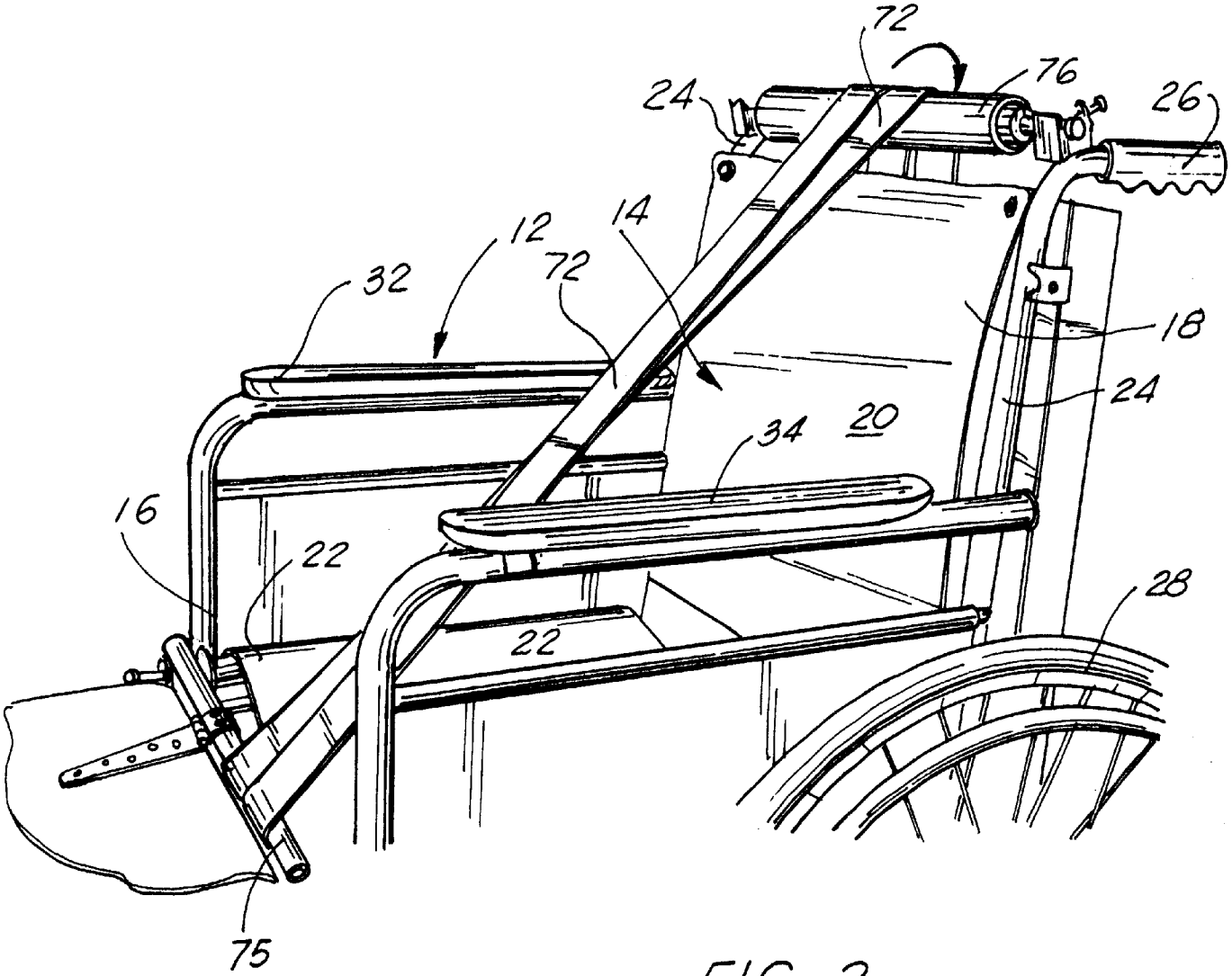
FIG. 2 is a side view of the strap members in the extended position in the apparatus of the present invention.

FIGS. 1 through 6 illustrate the preferred embodiment of the present invention by the numeral 10. In combination, the present invention 10 includes a typical wheelchair 12, with lifting components mounted to the wheelchair 12 so that the modified wheelchair carries out the function of the present invention. As illustrated in FIGS. 1 and 2, typical wheelchair 12 comprises a seat portion 14, having a flat seat 16 and an upright back 18. As with a typical wheelchair 12, the seat 16 and back 18 may be constructed of a flexible material, such as heavy-duty plastic 20, secured between a pair of seat frame members 22, and a pair of upright back frame members 24. As with a typical wheelchair, the back frame members 24 terminate at their upper ends in handles 26, which may be gripped by a person 27 at the rear of the chair to move the chair. Of course the chair 12 also includes a pair of large rear wheels 28, and a pair of smaller, front wheels 30, all of which provide mobility to the chair. As in all wheelchairs 12, the pair of handles 32, 34, extending between frame members 22 and 24, serve as a means for a person within the wheelchair to grasp the chair during certain functions. All of these features heretofore recited are found in most, if not all wheelchairs 12.

Turning now to the Figures, reference is made to the invention 10 as it is secured to wheelchair 12 in the combination of the present invention. As illustrated in the Figures, there is further provided a pair of upright members 40, 42 which extend and are secured to the back frame portions 24 at a first upper end point 44, with the members 40, 42 extending down to a terminating point 46, where the lower end of members 40, 42 is secured at a second point 50 adjacent the wheels 28. Each of the members 40, 42 include a channel 52 along the entire length of members 40, 42 with the channels 52 facing inwardly, to accommodate the upward and downward movement of a transverse bar 56, as seen in FIG. 1. Transverse bar terminates within each of the channels 52 allowing the bar 56 to slide upward and downward within channel 52 as the bar is moved upward and downward. As noted, the bar includes a first foot actuated member 60 which has upper ends 62, 64 attached to the bar 56, and a U shaped body portion 66 which forms a horizontal foot support portion 68, the function of which as will be described further. Further, the bar 56 accommodates the terminating end 70 of a pair of flexible strap members 72 again, the function of which will be described further.

Reference is now made to FIG. 2, where it is illustrated that the flexible strap members 70 terminate at a second end 73 secured to a rigid stationary transverse bar 75 located across the front portion of the chair at the level of the seat 20. As illustrated in FIG. 2, each of the strap members 70, 72 has been pulled taut and form a direct straight path between an upper roller 76 connectedly engaged across the upper portion of the upright frame members 24 as illustrated. Therefore, the manner in which the straps are pulled taut, as illustrated in FIG. 1, wherein a person 27 has pushed down on the U shaped frame 60 attached to movable bar 56 which engages the terminating ends 72 of strap members 70. When the bar is moved downward in the direction of arrow 80, the strap members are pulled from a first slack position to a second extended or taut position as seen in FIG. 2. The function of this feature will be described further.

Figure 3:
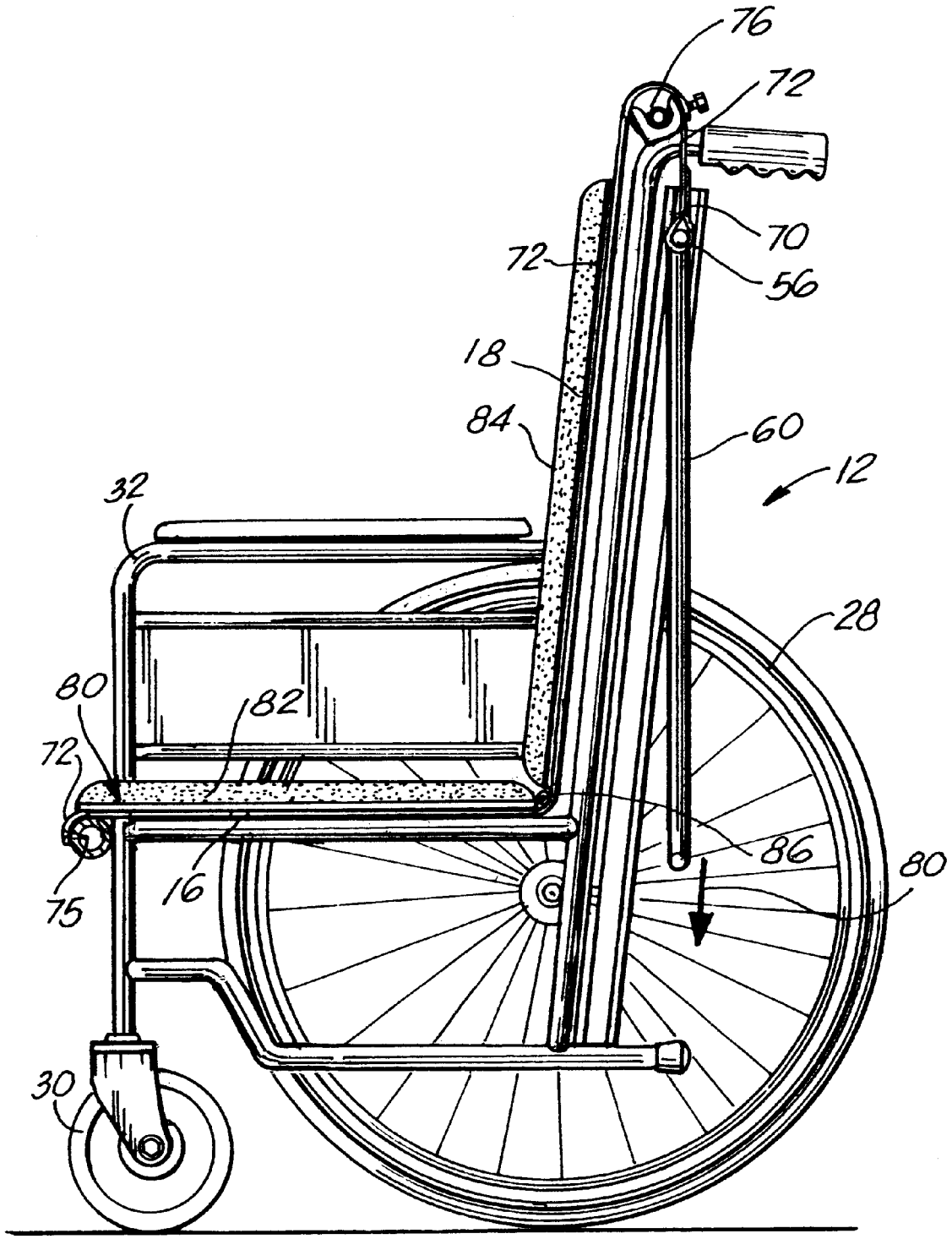
FIG. 3 is a side cross-sectional view of the apparatus of the present invention illustrating the seat in the sitting mode.
Figure 4:
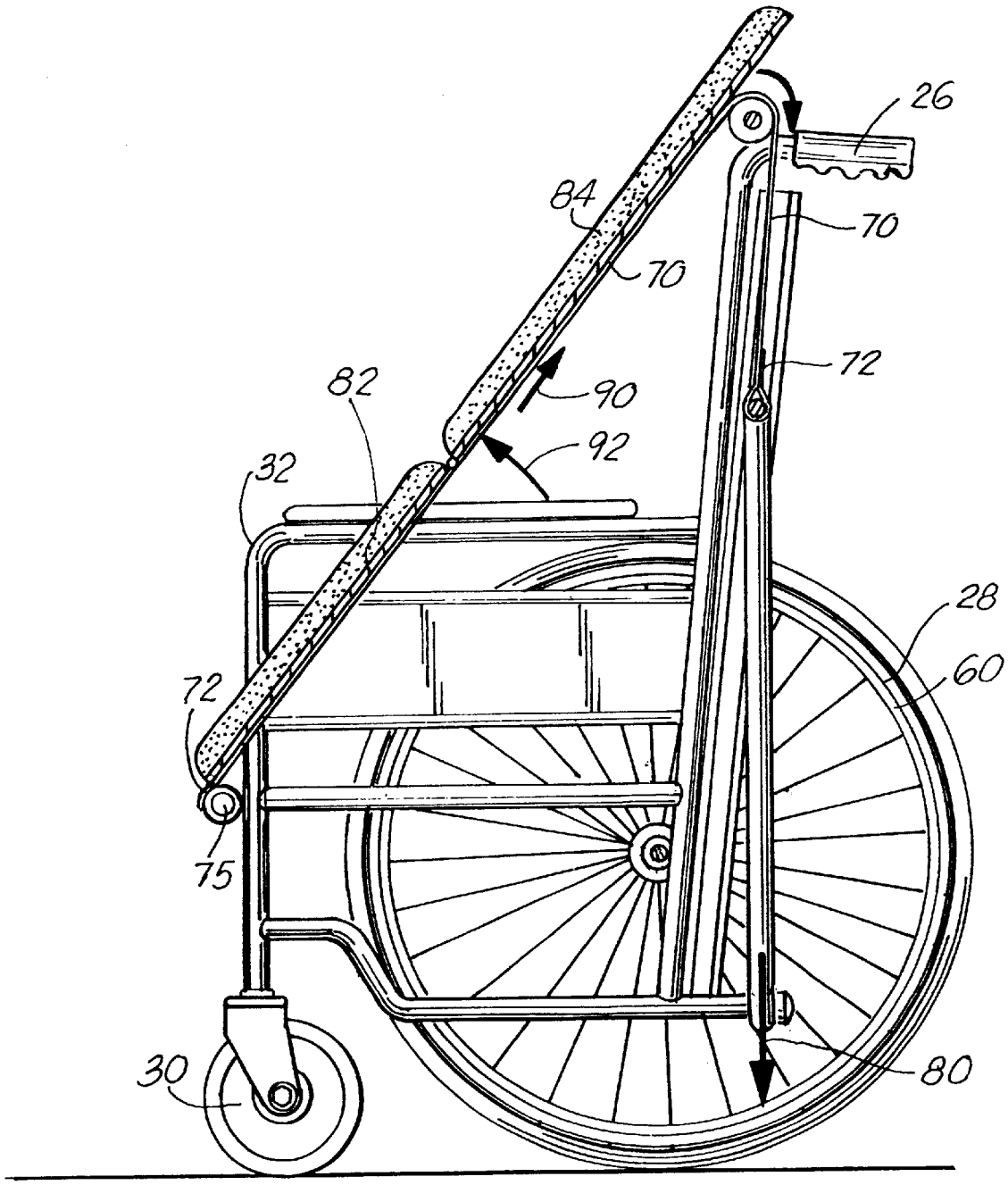
FIG. 4 is a side cross-sectional view of the apparatus of the present invention illustrating the seat in the lifting mode.

Turning now to FIG. 3, reference is made to the wheelchair 12 as it would appear with the U-shaped foot actuated bar member 60 in the up position with the straps 70, the first terminating ends 72 secured to transverse bar 56 and looping over the roller 76. The straps 70 then extend downward along the back 18 of chair 12, and along the seat portion 16 of the chair 12. The second ends 73 of the straps are fixedly secured to the stationary bar 75. At this point, it is noted that the straps 70 are in the full extended position and are resting along the back 18 and seat 16 of the chair 12. One feature of the chair 12 which most wheelchairs don't have, as illustrated in FIG. 3 and other figures, is the fact that there is a secondary seat 80 which comprises a first padded seat portion 82 and an upright padded back portion 84. Each of these portions 82, 84 are secured together via a hinge member 86 which allows the seat and the back portion to move from a first position, as seen in FIG. 3, where a person can be seated in the chair 12, to a second position, as seen in FIG. 4, where the back 18 and the seat member 16 are extended flat and pulled away from the chair. The manner in which this occurs is when the foot actuated member 60 is pushed downward in the direction of arrow 80, as seen in FIG. 1, this downward movement of the member 60 puts downward stress on straps 70 wherein the straps 70 are moved from the position as seen in FIG. 3 to the straight position as seen in FIG. 4. In this manner, although the original flexible seat portion 14 is maintained on the chair 12, the secondary seat portion 80 is pulled to an upright position in the direction of arrow 90, by the straps 70 being pulled taut as was described earlier in FIG. 2.

Therefore, if one uses this operation of chair 12, and while a person is seated in the chair, one could well imagine that a person would be seated in the chair, as seen in FIG. 3, with the person seated on the secondary seat member 80 in a comfortable position. At the point that the person in the chair 12 would like to be raised from a first seated position to be helped upright. In the case of an invalid or a weak person, reference is made to FIG. 1 where a care giver could simply hold onto handles 26, and with a downward movement of the foot on portion 68 of frame 60, the straps are moved from the seating position, as seen in FIG. 3, to the position, as see in FIG. 4, outward in the direction of arrow 92. When this occurs, of course, the person seated on the seat 82 would be moved from the seated position, as seen in FIG. 3, to an almost standing position, as seen in FIG. 4. This movement would be a great assist in moving the person upward and forward from the chair 12. While the person is gripping onto side handles 32, 34 of the chair, the person could move to a substantially standing position quite easily. Of course, once a person has moved to the standing position, the pressure on the foot member 68 could be relieved, and the strap would be allowed to return to the position as seen in FIG. 3 with the seats refolding back into the seating position.

Figure 5:
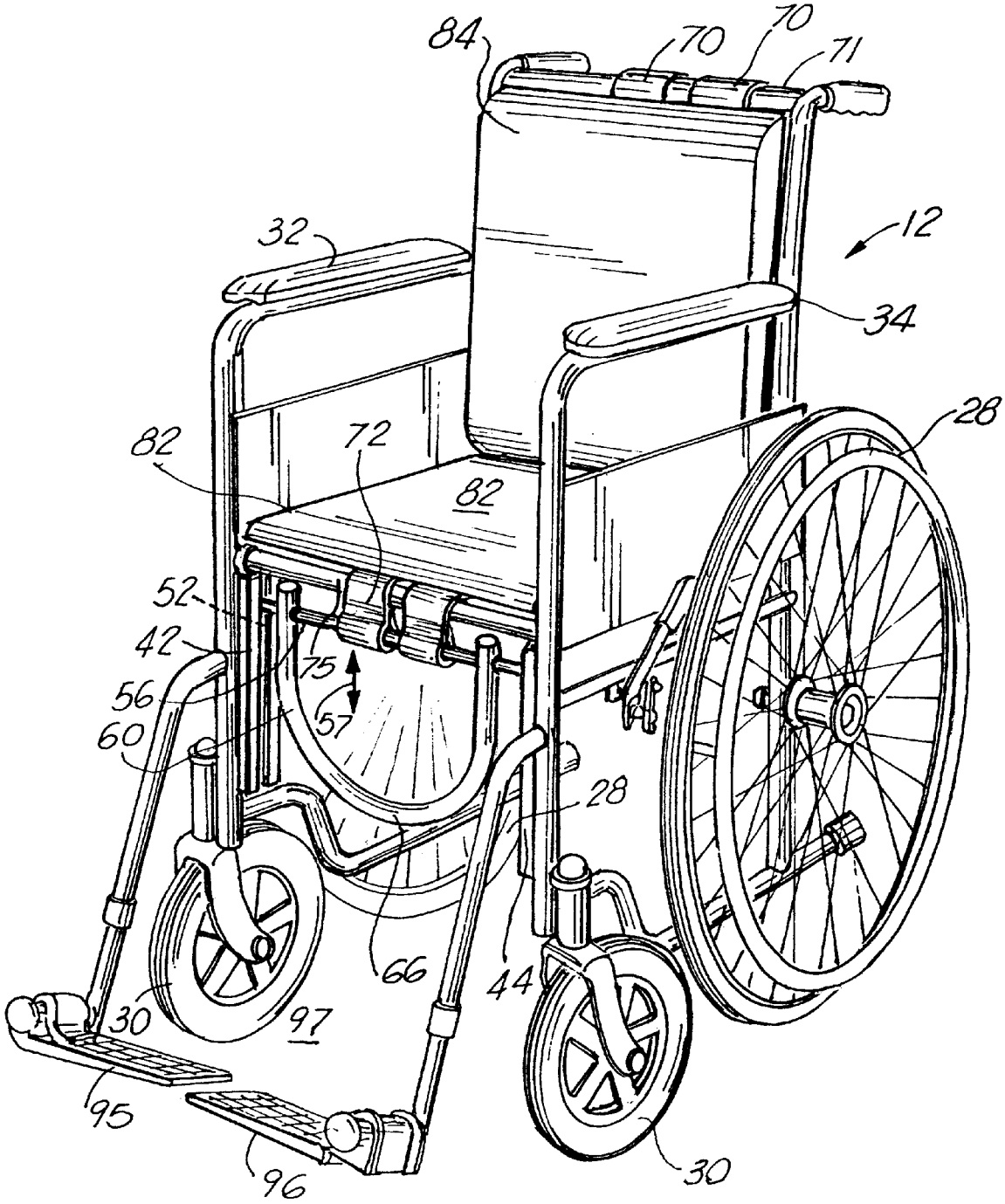
FIG. 5 illustrates an overall view of a second embodiment of the invention with the lift mechanism mounted to the front of a typical wheelchair.
Figure 6:
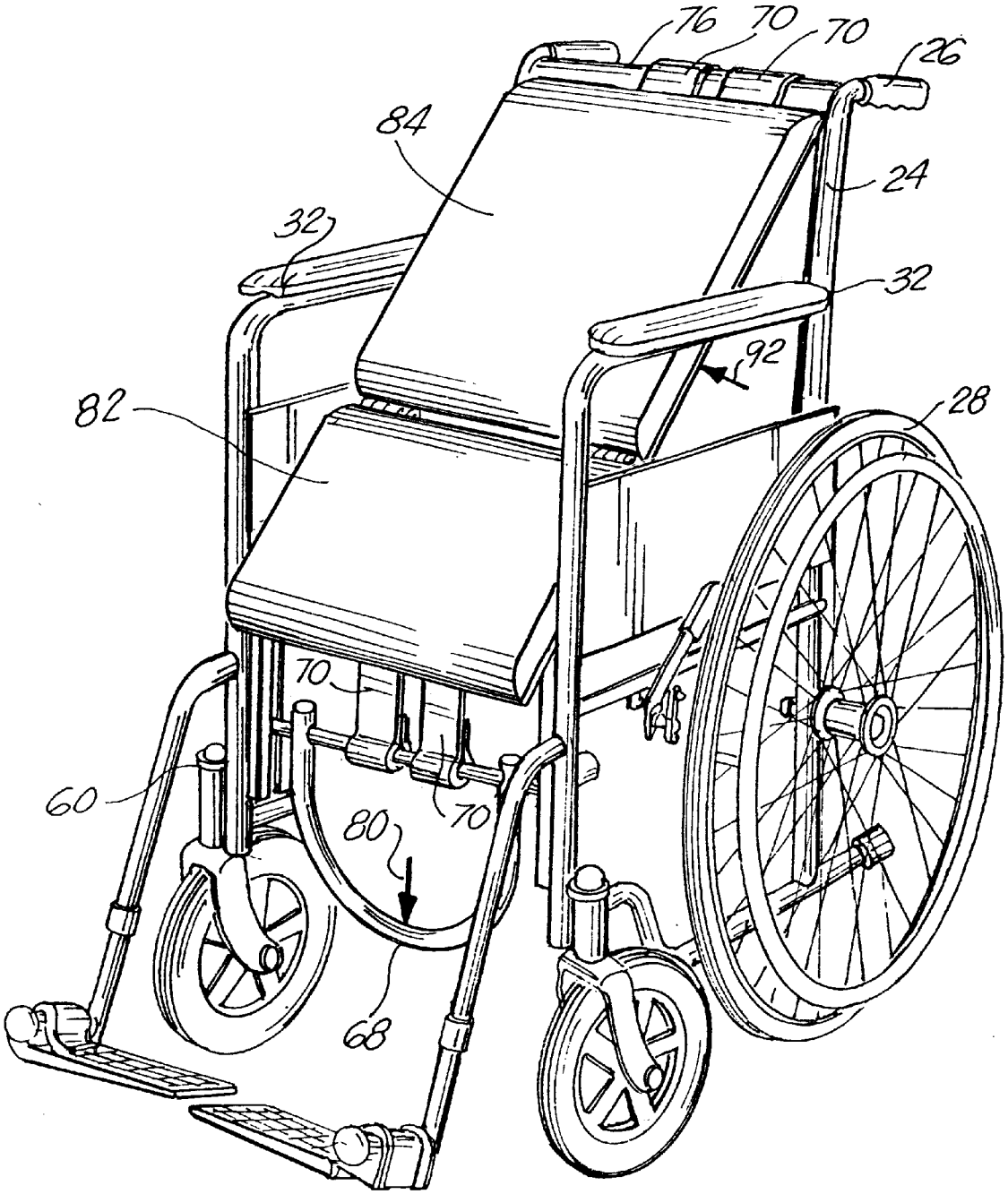
FIG. 6 illustrates an overall view of a second embodiment of the invention with the lift mechanism mounted to the front of a typical wheelchair and moved to the lifting mode.

In an additional embodiment, reference is made to FIGS. 5 and 6 where again there is included the wheelchair 12 with the same components as was identified in the chair as illustrated in FIG. 1, except for the following features. As seen in FIG. 5, the upright frames 42, 44 and the components which move up and down within those frames have been moved to the front of the chair where again there is illustrated a first upright frame 42, a second frame 44, each of the frames including a channel 52 therein for allowing movable bar 56 to move upward and downward in the direction of arrow 57 by putting downward pressure on the U shaped member 60. Also, there is included the terminating end 75 of the straps 72 secured to the movable bar 56 and the straps again would extend beneath the seat portion 82 and the back portion 84 to terminate in a second end 70 secured around a stationary bar 71, which would take the place of the roller 76, as was described in the first embodiment. In this particular embodiment, as seen in FIGS. 5 and 6, there would be a person seated in chair 12, and the person would be in the need of being lifted from the chair. Therefore, the foot pedals 95 and 96 could be moved to the upright position so that a care giver could move in the space 97 between the foot pedals 95, 96 and grasp the hands of the person seated in the chair 12. When this care giver has grasped the hands of the person, the care giver would push downward on frame 60 at point 66, and when doing so would move the strap members from the seated position, as seen in FIG. 5, to the taunt position as seen in FIG. 6. When this is done, again a similar effect would occur as was described earlier in relation to FIG. 4. That is, the back portion 84 and the seat portion 82 would move from the first seated position, as seen in FIG. 5, to a straight, substantially upright position as seen in FIG. 6. When this occurs, as the seats are being straightened, the care giver would help pull the person from the chair quite easily instead of having to pull the person completely from a straight seated position.

Again, it is foreseen that this invention can be retrofitted to any existing wheelchair and could accommodate any existing wheelchair that is constructed in a similar manner as is seen in the drawings and described in the specification. Also, this invention could be adapted to be included as part of any newly constructed wheelchair and could operate in the same fashion in either manner. It has been shown that the downward force that must be placed on either of the members 60 whether it be in the rear of the chair or the front of the chair is quite minimal in order to have the straps move from the seated position to the taut position as seen in FIGS. 4 and 6. It is through this minimal effort which makes it quite effective for the invention to operate with even quite a large person seated in the chair so that they are easily assisted out of the chair during use.

Of course, if a person who is invalid or weak wants to return to the chair, it is foreseen that the seat could be placed in the positions as seen in FIGS. 4 and 6 and the person could simply lean back against the seat while pressure is being placed on the foot actuated member 60, and the person could simply let the foot actuated member rise very slowly and move the seat from the position as seen in FIGS. 4 and 6, to the seated position as seen in FIGS. 3 and 5. This, of course, would allow a large or weak person to move quite comfortably into the chair without having fear of falling into the seat and perhaps injuring oneself or being banged up against the seat as the person falls therein.

The foregoing embodiments are presented by way of example only; the scope of the present invention is to be limited only by the following claims.

What is claimed is:

1. An apparatus, adaptable to a wheelchair, for assisting a person seated in the wheelchair to move to a standing position, the apparatus comprising:

a. a member slidable upward and downward along the chair;

b. a seat, having a seat portion hinged to a back portion;

c. at least one flexible strap member, engaged at a first end to the slidable member, and traveling along an under surface of the seat, and engaged at a second end to a stationary portion of the wheelchair, so that when the slidable member is moved to a down position, the flexible strap is pulled taut beneath the seat, lifting the seat from a sitting position to a substantially raised flat position, so that a person sitting in the seat is likewise lifted from a seated position to a partially standing position.

2. The apparatus in claim 1, wherein the seat member having a seat portion hingedly engaged to an upright back portion is supported in a permanent seat of the wheelchair.

3. The apparatus in claim 1, further comprising a pair of channels formed along the rear of the chair which allows the member to slide upward and downward.

4. The apparatus in claim 1, wherein the slidable member is engaged to a foot-actuated member for moving the member up and down.

5. The apparatus in claim 1, further comprising a roller along the back of the chair for allowing the straps to move over the roller as the slidable member is move upward and downward.

6. The apparatus in claim 1, wherein there is included at least two strap members.

7. The apparatus in claim 1, wherein the slidable member may be secured to the rear of front of the wheelchair.

8. An apparatus in combination with a wheelchair, for assisting a person seated in the wheelchair to move to a standing position, the apparatus comprising:

a. a member slidable upward and downward along the rear of the chair;

b. a seat, having a seat portion hinged to a back portion;

c. at least one flexible strap member, engaged at a first end to the slidable member, and traveling along an under surface of the seat, and engaged at a second end to a stationary portion of the wheelchair;

d. means on the slidable member for allowing a person to move the slidable member from a first up position to a second position, so that when the slidable member is moved to the second down position, the flexible strap is pulled taut beneath the seat, lifting the seat from a sitting position to a substantially raised flat position, so that a person sitting in the seat is likewise lifted from a seated position to a partially standing position.

9. The apparatus in claim 8, further comprising a pair of channels formed along the rear of the chair which allows the member to slide upward and downward.

10. The apparatus in claim 8, wherein the slidable member further comprises a portion which is foot-actuated member for moving the member up and down by a third person.

11. The apparatus in claim 8, further comprising a free-rolling member along the back of the chair for allowing the straps to move over the free-rolling member as the slidable member is move upward and downward.

12. The apparatus in claim 8, wherein there is included at least two strap members.

13. An apparatus in combination with a wheelchair, for assisting a person seated in the wheelchair to move to a standing position, the apparatus comprising:

a. a member slidable upward and downward along the front of the chair;

b. a seat, having a seat portion hinged to a back portion;

c. at least one flexible strap member, engaged at a first end to the slidable member, and traveling along an under surface of the seat, and engaged at a second end to a stationary portion of the wheelchair;

d. means on the slidable member for allowing a person standing in front of the wheelchair is able to move the slidable member from a first up position to a second position, and the flexible strap is consequently pulled taut beneath the seat, lifting the seat from a sitting position to a substantially raised flat position, so that a person sitting in the seat is likewise lifted from a seated position to a partially standing position.

* * * * *